US005094303A

United States Patent [19]

Jenne

[11] Patent Number: 5,094,303

[45] Date of Patent: Mar. 10, 1992

[54] IMPACT APPARATUS AND PROCESS FOR THE CONTROL OF IMPACT APPARATUS

[75] Inventor: Dietmar Jenne, Strengelbach, Switzerland

[73] Assignee: Terra AG, Switzerland

[21] Appl. No.: 656,953

[22] Filed: Feb. 15, 1991

[30] Foreign Application Priority Data

Feb. 19, 1990 [CH] Switzerland ..... 523/90

[51] Int. Cl.[5] ..... E21B 4/14

[52] U.S. Cl. ..... 173/91; 173/135; 91/234; 175/296

[58] Field of Search ..... 173/91, 135; 175/19, 175/57, 92, 296; 91/25, 234, 277

[56] References Cited

U.S. PATENT DOCUMENTS

| | | | |
|---|---|---|---|
| 4,295,533 | 10/1981 | Schmidt | 173/91 |
| 4,480,525 | 11/1984 | Jenne | 91/234 |
| 4,705,119 | 11/1987 | Kostylev et al. | 175/296 |
| 4,821,813 | 4/1989 | Jenne et al. | 173/91 |
| 4,932,483 | 2/1990 | Rear | 175/296 |

*Primary Examiner*—Frank T. Yost
*Assistant Examiner*—Scott A. Smith
*Attorney, Agent, or Firm*—Bachman & LaPointe

[57] ABSTRACT

In a device for controlling a pneumatic pile-driving or ram drilling apparatus having an internal, reciprocating ram, the control is effected in a forward stroke phase, a reverse stroke phase, and a subsidiary phase for the supply of air via a control device to a ram. The subsidiary control phase is a delay phase, in which subsidiary compressed air is fed to the front of the ram via time-delay means to take effect with an interval after that flow begins whereby to be substantially effective only in extending the reverse stroke of the ram. An apparatus is provided having a housing, in which the ram is reciprocated and compressed air admission is controlled by the control device which projects into the rear face of the ram and cooperates with the control ports in the ram to control the forward and reverse stroke movements of the ram. At least one supplementary control port, provides a time-delay device with which subsidiary compressed air is additionally fed on to the front of the ram. The secondary port extends rearwards towards the exterior and is axially forwards of the control port in the ram, such that admission of air is essentially effective only for extending the reverse stroke phase.

3 Claims, 2 Drawing Sheets

IMPACT APPARATUS AND PROCESS FOR THE CONTROL OF IMPACT APPARATUS

BACKGROUND OF THE INVENTION

The invention relates to impact apparatus in the form of pile-driving apparatus or ram-boring apparatus and to a process for controlling such apparatus.

A device for controlling the forward and reverse strokes of self-driven, pneumatic pile-driving apparatus is described in DE 3104547—JENNE. Such pile-driving apparatus has a tubular housing in which an axially movable ram is located between two stops; the compressed air for the forward and reverse strokes of the ram can be supplied via a control sleeve connected to the compressed air line. This control sleeve is located so that its first, air inlet end, can rotate in a bearing bush disposed near the end of the housing, but cannot move axially. At its other, forward end it has a control head in the form of a piston, which is inserted in a cylindrical bore at the rear end of the ram. The ram itself extends axially in the housing and cannot rotate, and it has at least one pair of radial control ports of different sizes which cooperate with the control sleeve. The control sleeve has respective pairs of control edges associated with said control ports for the forward and reverse strokes of the ram. The edges of each pair are arranged staggered axially with respect to each other, and the pairs of edges are arranged staggered circumferentially to each other.

Despite the relative increase in impact energy obtained by the arrangement of the pair of control ports of different sizes, it is disadvantageous that they act both during the forward stroke and during the reverse stroke. This causes the forward motion of the ram to be impeded.

Moreover the fixed association of pairs of control edges with supplementary ports is a disadvantage, since it both restricts the choice of manufacturing method and complicates the manufacturing process.

This known arrangement of the main and supplementary control ports also results in a poor utilisation of compressed air and compressed air energy, which means that larger compressors and larger on-site installations are necessary. These also have to be transported to and from the site each time, and therefore lead to even greater costs.

SUMMARY OF THE INVENTION

One object of the present invention is to provide an improved process for the control of impact apparatus such as pile-driving apparatus or ram-boring apparatus.

Another object is to provide such apparatus with a control system which does not exhibit the above-mentioned disadvantages, and in particular consumes a smaller amount of compressed air.

A further object of the invention is to provide an apparatus which has an increased impact effectiveness, ie. its economy of operation should be increased several times compared with the prior art apparatus.

According to one aspect of the invention, there is provided a process for controlling a pile-driving apparatus or a ram-boring apparatus in which an internal ram reciprocates with forward and reverse stroke movements, the control of said ram movement comprising a forward stroke control phase, a reverse stroke control phase, and a supplementary control phase in which an additional flow of compressed air is supplied during part of its forward and reverse stroke movements, said supplementary control phase acting with a time delay to feed the additional flow of air to the front face of the ram to take effect at a time of action which is delayed with respect to the actuation of said flow, whereby said additional air is substantially only effective in extending or accelerating the reverse stroke phase during the reverse stroke movement of the ram.

According to another aspect of the invention, there is provided a pile-driving apparatus or a ram-boring apparatus comprising a housing having an impact head, in which a ram is axially reciprocable forwards and backwards by the admission of compressed air by a control device so that the ram strikes a front face of the housing during the forward stroke, or strikes rear face of the housing during the reverse stroke, said control device projecting into the part of the ram which further from forward end of the ram and cooperating with at least one main control port in the ram for said control of the forward and reverse stroke movements of the ram, at least one supplementary control port being provided in addition to said main control port through which supplementary control port an additional supply of compressed air is fed to the front face of the ram in addition to a supply fed from said main port, said supplementary control port being formed as a time-delay device and being disposed in a direction which extends rearwards to the exterior and in a position forwards from the or at least one main control port in the ram, whereby the admission of compressed air therethrough to the ram front face essentially occurs during the reverse stroke movement of the ram for extending the reverse stroke phase, and there is substantially no effect during the forward stroke movement of the ram from the additional compressed air flowing through said supplementary control port.

DESCRIPTION OF THE PREFERRED EMBODIMENTS

Figure 1:
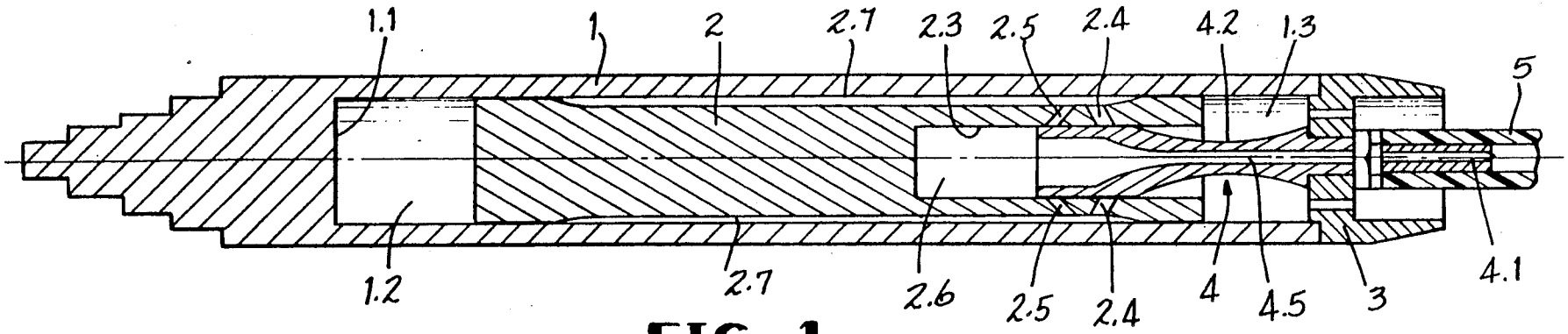
FIG. 1 is a first embodiment of a pile driving apparatus according to the invention, shown in cross-section.

Further characteristics and advantages of the invention will be apparent from the description of the process and apparatus in accordance with the invention illustrated in the accompanying drawings.

Process

In order to operate a pile driver or ram-drilling apparatus for setting tubes in the ground without excavation at an improved level of efficiency, ie. with better utilisation of the compressed air energy and therefore with a reduced consumption of compressed air, leading to compressors and other on-site installations which are somewhat smaller and easier to transport, the displacement of a ram inside the pile driver device, composed of partial displacements in its forward and reverse strokes, is controlled by a suitable supply of compressed air to an expansion chamber.

The preferred overall control process can be broken down in principle into a number of control phases, comprising a forward stroke control phase for the forward movement, a reverse stroke control phase for the reverse movement, and a supplementary control phase associated with each of these first two phases. In each supplementary control phase, additional compressed air is fed to the front face of the ram, into the space between the tip of the ram and the front internal face of the housing of the apparatus which forms the expansion chamber.

The moment of actuation and the control periods for this additional compressed air have been so selected previously that fail to obtain the improvement which is possible if the control process is to be optimised. To achieve this, the supplementary control phase is now designed as an air-delay control phase, and the additional compressed air fed to the front face of the ram is brought into action, delayed with respect to its control time, via a time-lag device. Due to this displacement of the time of action of the additional compressed air in the expansion chamber, said additional air is effective essentially only in prolonging the reverse stroke phase during the reverse movement of the ram, and is not effective during the forward movement of the ram.

The displacement cycle of the ram comprises a forward stroke movement and a reverse stroke movement. The forward stroke movement results from admission of compressed air onto the rear face of the ram in the region of its cylindrical cavity, and the reverse stroke movement results from the indirect admission of compressed air onto the front face of the ram in the region of the expansion chamber, and the subsequent expansion of the compressed air. The course of such a displacement cycle is controlled by means of a process which essentially comprises a forward stroke control phase and a reverse stroke control phase, corresponding to the forward and reverse motion. To obtain better utilisation of compressed air, the supplementary control phase, namely a secondary control phase, is assigned to each of these two main control phases. Additional compressed air is fed into the expansion chamber during this supplementary control phase. In order now to optimise the control process and to make the best possible use of the energy of the compressed air, this known supplementary control phase is re-designed as an air-delay control phase, in which the additional compressed air is effective in the expansion chamber in both control phases with a time delay with respect to its control timing.

Process Sequence

Supposing that the starting position for the forward motion is the rearward, cover-side dead centre position of the ram 2 shown in the drawings. Compressed air is fed through the central bore 4.5 of a control device 4 into a cylindrical cavity 2.6 at the rear end of the ram 2, whereby the latter is displaced forwards in the direction of the arrow. During this forward movement (forward stroke), one or more supplementary control ports 2.5 in the ram 2 are first brought into the region of a forward control edge 4.3 of a stationary control device 4. Compressed air from the central bore 4.5 begins to flow through these supplementary control ports after a first forward stroke time interval which forms part of a forward stroke control phase. Due to the use of a time-delay device 2.5, this additional compressed air flow is very considerably delayed with respect to its control timing, ie. the time-delay device displaces the time of action so that it is very considerably later than the inflow control time, ie. the control time at the port; this results in this additional compressed air having only a very slight effect or no effect at all in the expansion chamber 1, which moreover is substantially un-pressurised at this time. The difference between the control times of the supplementary control port 2.5 and the corresponding main control port 2.4 is chosen so that, only a short time later, at the end of the first forward stroke time interval, which is simultaneously the start of the second forward stroke time interval, which however belongs to the reverse stroke control phase, the main control ports 2.4 are uncovered by the front control edge 4.3. A quantity of the main compressed air, which is large in relation to the additional compressed air, then flows via the annular space 2.7 into the substantially un-pressurised expansion chamber 1.2. As a result, the small quantity of additional compressed air which reached the empty expansion chamber 1.2 during the forward stroke control phase exerts practically no braking effect on the forward stroke of the ram 2. The ram 2 strikes the front internal face 1.1 of the housing 1 with an energy level which is substantially not reduced by the effect of the additional compressed air (forward stroke of the apparatus). The moment of impact on the front internal face 1.1 of the housing 1 represents the front dead centre of the movement of the ram.

Figure 4:
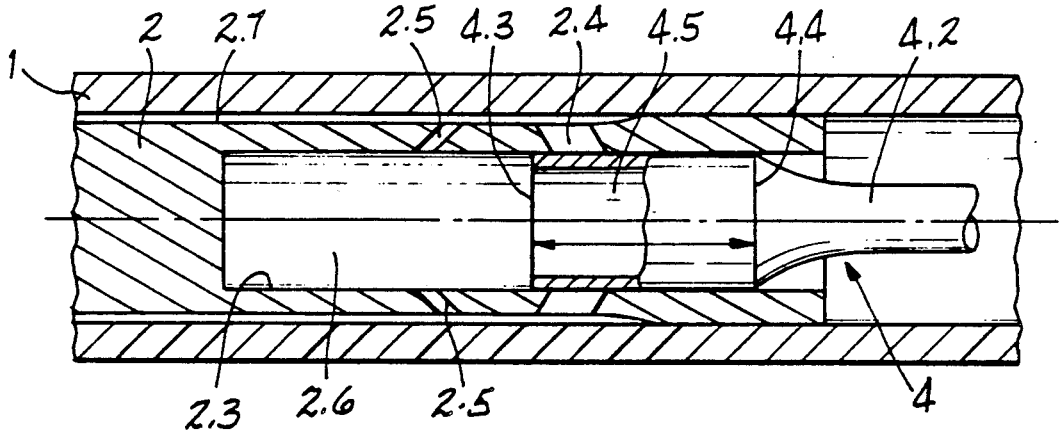
FIG. 4 shows the same detail of the apparatus of FIG. 1 at a position after the end of a first reverse stroke time interval: the main control ports are closed by the front control edges of the control device.

The reverse stroke movement of the ram 2 which forms part of the same control cycle (FIG. 4), beginning at the forward dead centre, is maintained by the main compressed air flow entering through the main control ports 2.4 and its expansion in the expansion chamber 1.2. During a first reverse stroke time interval the main control ports 2.4 are first closed by the front control edges 4.3 of the control device 4, and the supply of the main compressed air for the reverse stroke of the ram 2 is cut off. In a second, subsequent reverse stroke time interval, additional compressed air still flows into the annular space 2.7 through the supplementary control ports. This second reverse stroke time interval is selected so that it lasts until the closure of the secondary control ports 2.5 by the front control edge, which takes place shortly after the closure of the main control ports 2.4. As the main control ports 2.4 ar still kept closed by the control device 4 during this second reverse stroke time interval—since the main control ports 2.4 have not yet passed the rear control edge 4.4—this additional compressed air causes an extension of the expansion phase of the accumulated quantity of compressed air in the expansion chamber 1.2. This means that more compressed air is available for the expansion and therefore there is a longer acceleration path for the ram 2 during the expansion phase compared with that corresponding to the quantity of main compressed air which has entered via the main control ports 2.4.

The position of the rear control edge 4.4 is arranged in relation to that of the front control edge 3.4 so that the ram 2 has sufficient energy for the return stroke to its rear dead centre, which is located before the impact on the cover 3 of the housing 1. As soon as the main control ports 2.4 have been traversed the expansion phase is ended, because with this the expansion chamber 1.2 is connected via a flow discharge chamber 1.3 to the outside atmosphere for complete evacuation. As a result of its kinetic energy, the ram 2 still continues to move until it reaches its rear dead centre, which completes the displacement cycle.

Process Summary

Due to this delayed effect of the additional compressed air compared with its inflow control time, resulting from the time-delay device 2.5, which for the operation of the process can be constructed as a supplementary control port 2.5 sloping towards the rear, on the one hand no braking effect occurs during the forward stroke of the ram, and therefore there is no reduction of the critical energy of the ram 2 before its impact on the front internal face 1.1 of the housing 1, and on the other hand the additional compressed air is added to the expanding compressed air in the expansion chamber 1.2 in front of the tip of the ram 2 at a later point in time as compared with the prior art apparatus referred to above, during the reverse stroke of the ram. By this means an extension of the expansion phase results, compared with the known control processes for the return stroke of the ram, and there is thereby an extension of the acceleration path during the forward stroke of the ram. Both effects together produce a massive increase in the impact effect of the pile driver device compared with previous control processes.

Apparatus

Referring initially to FIG. 1 of the drawings, the pile driving apparatus comprises a substantially tubular housing 1, the tip of which is shaped for forcing into the ground. Within the housing 1 there is disposed a likewise partially tubular ram 2, which can move longitudinally inside the housing. Between the ram and the housing 1 there is an annular space 2.7 or channels with the same effect along the barrel of the ram 2, through which air can flow to expansion chamber 1.2 at the forward or tip end of the ram 2. The rear end of the housing 1 is closed with a removable cover 3. In the cover 3 a control device 4 is seated, one (external) end 4.1 of which projects outwardly and is fitted with a connection for at least one compressed air line 5. Another (internal) end 4.2 of the control device projects into a rear end of the ram 2 and is a sliding fit in the internal surface of its barrel 2.3. The outer face of this internal end 4.2 of the control device 4 has a pair of opposite control edges 4.3 or 4.4 which cooperate with corresponding control ports 2.4 in the ram 2 in order to control the forward and reverse stroke movements of the ram in the housing. The control device 4 has a central bore 4.5 which extends over its whole length; this is connected to said at least one compressed air line 5 at the external end 4.1 of the control device 4.

At least one supplementary control port 2.5 is provided in the ram 2 in addition to the control ports 2.4, which latter can also be termed the main control ports. Said supplementary port is formed as a time-delay device and extends sloping rearwards to the exterior in a position axially forwards of the main control port 2.4 in the ram 2. The position of the inner end of this supplementary control port 2.5 is about ⅓ of the stroke length of the ram 2 in front of the inner end of the main control port 2.4. The supplementary control port 2.5 preferably slopes backwards towards the main control port 2.4 at an angle of about 45° with respect to the longitudinal axis of the housing. However it is also possible to provide a slope of less than 45°, and therefore a more acute angle, with respect to the longitudinal axis of the housing. In this respect it is important that a significant time delay occurs, during the supplementary control phases on feeding the additional compressed air into the expansion chamber 1.2, as a result of the supplementary control port 2.5 sloping backwards. By this means the additional compressed air is essentially effective only in prolonging the stroke of the ram during the reverse stroke movement of the ram, and not during the forward stroke movement of the ram.

Operation of Apparatus

Figure 2:
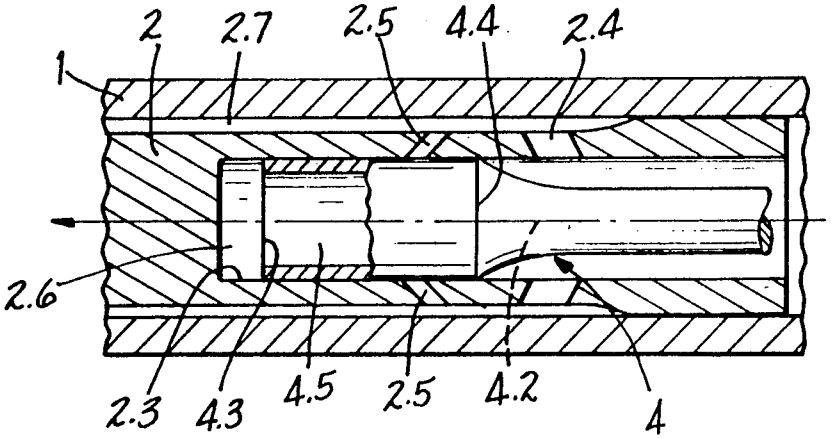
FIG. 2 shows a detail of the apparatus of FIG. 1 in the same cross-section and at a position of operation in the region of rear dead centre.
Figure 3:
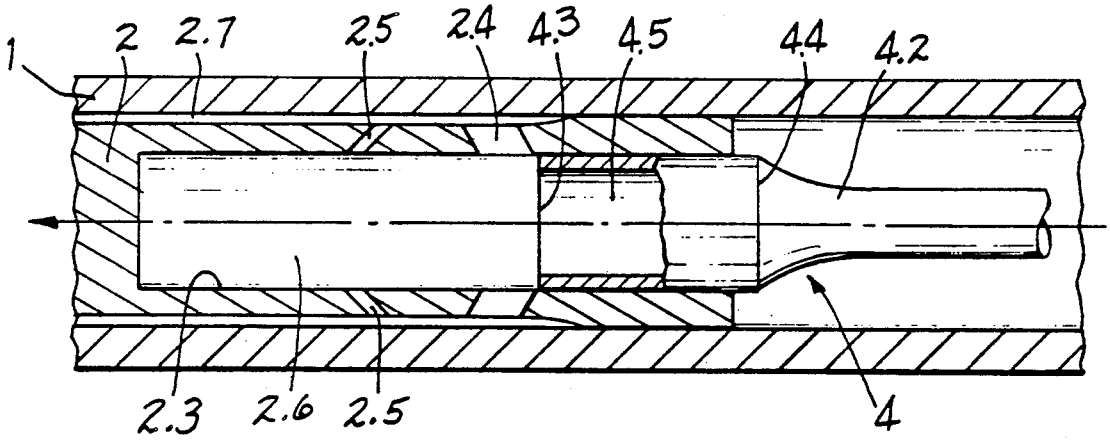
FIG. 3 shows the same detail of the apparatus of FIG. 1 at a position in the region of forward dead centre.

If the displacement cycle for the ram 2 begins at the starting position for its forward stroke movement, i.e. at its rear or cover-side dead centre (shown in FIG. 2), compressed air is supplied through the central bore 4.5 of the control device 4 into cylindrical cavity 2.6 in the ram 2 bounded by the internal surface of the barrel 2.3 and the control device and moves the ram 2 forwards as shown by the arrow on FIGS. 2 and 3. During this forward movement (forward stroke), one or more supplementary control ports 2.5 first reach the region of the forward control edge 4.3. Compressed air begins to flow after a first time interval through these supplementary control ports 2.5 in the ram 2, and into the annular space 2.7 between the ram 2 and the housing 1, or into corresponding longitudinal channels. This compressed air is termed additional compressed air, since it flows through the supplementary control ports 2.5. Due to the axial direction of the supplementary control ports 2.5 being substantially opposed to the direction of flow of the compressed air in the central bore 4.5, as determined by the backward sloping orientation towards annular space 2.7 or corresponding longitudinal channel, and due to the relatively small cross-section of the supplementary control ports, this flow of additional compressed air has a very considerably delayed effect in the expansion chamber 1.2 between housing 1 and the forward end of the ram 2, and may have no significant effect at all during the forward stroke. The time interval between the control moment—in its strictest sense this means the moment at the port or the inflow control time—and the moment of operation is in the range of about 0.03–0.05 sec. This action timing also depends, moreover, on the degree of evacuation of the expansion chamber 1.2, which in the above-mentioned control cycle was connected with the exterior for its evacuation. As the second forward stroke time interval is very short, namely less than 0.02 sec., the ram 2 strikes the front internal face 1.1 of the housing 1 shortly after the main control ports 2.4 open. As a result, the additional compressed air exerts substantially no braking effect on the forward stroke of the ram 2. The ram 2 strikes the front internal face 1.1 of the housing with an energy level which is not substantially reduced by the additional compressed air, i.e. it is not braked, and it drives the housing into the ground (forward stroke of the pile-driving apparatus). The moment of impact on the front internal face 1.1 of the housing corresponds to the front dead centre of the movement of the ram.

The reverse stroke movement (FIG. 4) of the ram 2 in the same control cycle begins at the front dead centre, and is caused by the compressed air flowing in through the main control ports 2.4 while the ram 2 is in the position shown in FIG. 3, and its expansion in the expansion chamber 1.2. After a first part of the reverse stroke the main control ports 2.4 are first closed by the front control edge 4.3 of the control device 4, and the supply of the main compressed air for the reverse stroke of the ram 2 is cut off. During a further part of the reverse stroke additional compressed air still flows into the annular space 2.7. This second part of the reverse stroke lasts until the closure of the supplementary control ports 2.5 by the front control edge 4.3, shortly after the closure of the main control ports 2.4.

As the main control ports 2.4 are still kept closed by the control device 4 during this second return stroke time interval—since the ports 2.4 have not yet passed the rear control edge 4.4—this additional compressed air causes an extension of the expansion phase of the compressed air accumulated in the expansion chamber 1.2. This means that more compressed air is available for the expansion and therefore a longer acceleration path for the ram 2 occurs during the expansion phase, compared with that corresponding to the amount of the main compressed air which has entered through the main control ports 2.4. The expansion phase is ended by the main control ports 2.4 traversing the rear control edge 4.4, because by this means the expansion chamber 1.2 is connected via a flow discharge chamber 1.3 to the outside atmosphere for complete evacuation. Due to its kinetic energy, the ram 2 still continues to move until it reaches its rear dead centre, which is arrived at as a result of the equilibrium between the force generated by its kinetic energy and the opposing force of the compressed air acting on it in the central bore 2.6. The next displacement cycle of the ram 2 now follows.

Figure 5:
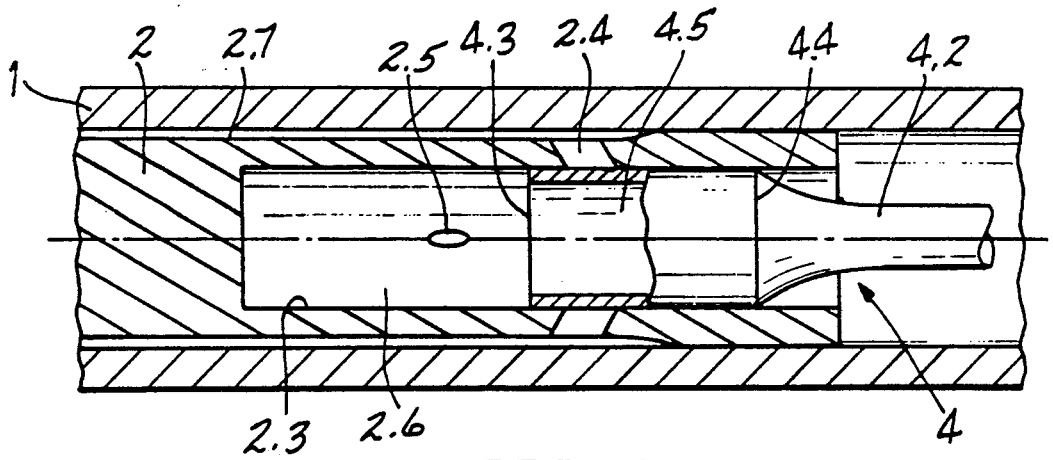
FIG. 5 is a similar cross-section detail view of a second embodiment of pile driving apparatus according to the invention.

A second embodiment of the pile-driving apparatus is illustrated in FIG. 5 and comprises a substantially tubular housing 1, the tip of which is designed for forcing into the ground, and a likewise partially tubular ram 2, movable longitudinally inside the housing 1. Between the ram and the housing 1 there is an annular space 2.7, or channels with the same effect, along the barrel of the ram 2, through which air can flow forward interior space of the housing beyond the tip of the ram 2. The rear end of the housing 1 is closed with the removable cover 3, in which the control device is seated. The cover 3 and control device 4 can be as shown in FIG. 1, with one (external) end 4.1 of the device projecting out of the cover and being fitted with a connection for at least one compressed air line 5. Another (internal) end 4.2 of the device projects into rear end 2.1 of the ram 2 and slides along the internal surface of its barrel 2.3. This internal end 4.2 of the control device 4 has a pair of opposite control edges 4.3 or 4.4, which act together with associated control ports 2.4 in the ram 2 to control the forward and reverse strokes of the ram in the housing. The control device 4 has a central bore 4.5 which extends over its whole length from said at least one compressed air line 5 to the ram bore 2.6.

At least one supplementary control port 2.5 is provided in the ram 2 in addition to the main control ports 2.4. The control port 2.5 is formed as a time-delay device extending sloping backwards to the exterior from a position axially in front of the main control ports 2.4, i.e. between the main control ports 2.4 and forward the tip 2 of the ram 2. The position of the inner end of this supplementary control port 2.5 is advantageously about ⅓ of the stroke length of the ram 2 in front of the inner ends of the main control ports 2.4. In this modified form of apparatus, the supplementary control port or ports are displaced circumferentially with respect to the main control port or ports. The or each supplementary control port 2.5 preferably slopes backwards towards an angle of about 45° with respect to the longitudinal axis of the housing. However it is also possible to provide a slope of less than 45°, and therefore a more acute angle, with respect to the longitudinal axis of the tube. In this respect it is important that a significant time delay occurs, during the secondary control phases in which the additional compressed air is to be supplied into the expansion chamber 1.2, as a result of the supplementary control port 2.5 sloping backwards. The supplemental control port 2.5 has a cross-section area which is about 3–25% of the cross-section area of the main control port 2.4. In this second embodiment the air flows from supplementary and main control ports have no effect upon each other, since these ports are not in alignment. The additional compressed air is therefore essentially only effective in extending the reverse stroke phase during the reverse stroke movement of the ram, and not during the forward stroke movement of the ram.

The reversal of the stroke in this second embodiment takes place in the same manner as has been described for the first embodiment. Due to the extended acceleration of the ram during its reverse stroke movement, caused by the secondary control phase, the impact velocity onto the cover 3—and therefore the reverse stroke velocity—is also increased during the reverse stroke movement of the pile driving or ram-drilling apparatus.

The two different forms of control ports in the embodiments described, where they slope towards each other, have the significant advantage that compressed air can flow into the front expansion chamber at different times and in different amounts. This leads to a significant increase in impact energy, higher propulsive output and lower air consumption, etc., and therefore overall to the significantly more economical use of the pile-driving apparatus.

I claim:

1. A pile-driving apparatus or a ram-boring apparatus comprising a housing having an impact head and front and rear internal faces, a ram within said housing, compressed air supply means and control means for admitting compressed air from said supply means to said ram whereby said ram is reciprocable forwards and backwards within the housing to strike at least one of said front and rear faces of the housing, said control device projecting into the ram and the ram having at least one main control port for cooperation with said control device for said control of the forward and reverse stroke movements of the ram and at least one supplementary control port in addition to said at least one main control port and through which an additional supply of compressed air is fed to the front face of the housing, said at least one supplementary control port being formed as a time-delay device and being disposed in the ram in a direction which extends rearwards to the exterior and being located in a position forwards from said at least one main control port in the ram, whereby said additional compressed air essentially only acts during the reverse stroke movement of the ram for extending the reverse stroke phase.

2. Apparatus according to claim 1, wherein said at least one supplementary control port has a cross-section area which is about 3–25% of the cross-section area of said at least one main control port.

3. Apparatus according to claim 1, wherein said at least one supplementary control port is formed as a bore.

* * * * *